United States Patent [19]

Kurando et al.

[11] Patent Number: 4,939,542

[45] Date of Patent: Jul. 3, 1990

[54] IMAGE FORMING APPARATUS WITH POTENTIAL CONTROL

[75] Inventors: Shigeo Kurando, Takatsuki; Hiromi Sakata, Nara; Masami Yamada, Osaka; Hidehiro Tabuchi, Sakai; Yukio Hashimoto, Kadoma; Yoshinobu Takemura, Nara, all of Japan

[73] Assignee: Mita Industrial Co., Ltd., Osaka, Japan

[21] Appl. No.: 349,850

[22] Filed: May 10, 1989

[30] Foreign Application Priority Data

May 23, 1988 [JP] Japan ..... 63-125142
May 23, 1988 [JP] Japan ..... 63-125143

[51] Int. Cl.[5] ..... G03G 15/00; G03G 15/02

[52] U.S. Cl. ..... 355/208; 355/219

[58] Field of Search ..... 355/203, 204, 208, 214, 355/216, 219, 246

[56] References Cited

U.S. PATENT DOCUMENTS 3,950,680 4/1976 Michaels et al. ..... 355/219 Y
4,248,519 2/1981 Urso ..... 355/208 Y
4,355,885 10/1982 Nagashima ..... 355/219 X
4,456,370 6/1984 Hayes, Jr. ..... 355/208

*Primary Examiner*—Joan H. Pendegrass
*Attorney, Agent, or Firm*—Beveridge, DeGrandi & Weilacher

[57] ABSTRACT

An image forming apparatus having a potential sensor for measuring a potential at the surface of a photoreceptor drum; a voltage generation circuit for generating a voltage lower than a voltage to be actually induced at the surface of the photoreceptor drum in the course of image formation; switching means for switching a condition so that the photoreceptor is connected to the voltage generation circuit or earthed; and charger-output control means for obtaining a value of a surface potential of the photoreceptor measured by the potential sensor at the time when a voltage form the voltage generation circuit is applied to the photoreceptor by operating the switching means, estimating by arithmetic operation, on the basis of the measured value thus obtained, a value to be measured by the potential sensor when a high voltage is actually induced at the photoreceptor surface in the course of the image formation, and controlling an output from the charger based on the value estimated by the above arithmetic operation when a voltage is applied to the photoreceptor surface by the charger prior to image forming operation.

11 Claims, 14 Drawing Sheets

IMAGE FORMING APPARATUS WITH POTENTIAL CONTROL

BACKGROUND OF THE INVENTION

The present invention relates to an image forming apparatus having a photoreceptor on which an electrostatic latent image is formed by exposure, and more particularly to an image forming apparatus that has been improved so as to control the electric potential of the photoreceptor to be uniform before the photoreceptor is exposed.

There are known image forming apparatus having a photoreceptor such as an electrophotographic copier, laser printer, electrophotographic facsimile and the like.

In an electrophotographic copier (hereinafter referred to as a copier) for example, there is provided a photoreceptor of a drum shape (hereinafter referred to as a photoreceptor drum). A photoreceptor drum is generally made of an aluminum tube and provided with a photosensitive semiconductor layer at the surface thereof The above copier is designed such that during image formation, the photosensitive semiconductor layer at the surface of the photoreceptor drum is charged to have a uniform potential by corona discharge of a charger for charging the surface of the photoreceptor drum, and the photosensitive semiconductor layer thus charged is then exposed to light thereby eliminating the electric charge in the exposed area thereof which will form an electrostatic latent image.

However, it often occurs that the electric charges are not evenly distributed in the photosensitive semiconductOr layer. It is required for obtaining an electrostatic latent image of good quality to control the distribution of electric charges.

To solve the above problem, such a method has been conventionally adopted that the condition of the electric charge distribution in a photosensitive semiconductor layer is checked by a measuring instrument in a manufacturing process of a copier and if the electric charges are not evenly distributed, they are adjusted.

Another method that has been adopted is that a potential sensor for measuring a potential at the surface of a photoreceptor drum is disposed in the vicinity of the photoreceptor drum and the measured value obtained by the potential sensor is fed back to a charger-driving circuit thereby maintaining a uniform potential at the surface of the photoreceptor drum.

In the case where a potential sensor is employed, a correction is required in the output from the potential sensor for the two reasons described below.

(a) The sensitivity varies depending on a potential sensor; and (b) When installing a potential sensor oppositely to the surface of a photoreceptor drum, it is a particular problem that the distance between the surface of a drum and a potential sensor slightly varies depending on a product.

To correct the output from the potential sensor, such a method is convenient that a high voltage is directly applied to the photoreceptor drum, the output from the potential sensor at that time is read out, and then a correction value is determined from the relationship between the output from the potential sensor and the high voltage that has been applied to the drum.

In a conventional copier, as illustrated in FIG. 11, a photoreceptor drum 1 is disposed being earthed via a connecting wire 2, connector 3 and connecting wire 4, and a developing roller 5 is connected to a developing bias circuit 9 via a connecting wire 6 and connector 7 and connecting wire 8. With use of the circuit having the above arrangement, the connector 7 is manually exchanged with the connector 3, a high voltage is applied to the photoreceptor drum 1 by means of the developing bias circuit 9, and then the output from the potential sensor 10 is read out at that time thereby correcting the output from the potential sensor.

The above method, however, can be only adopted on limited occasions, in a manufacturing process of a copier or at the time of maintenance carried out by a customer service engineer, for example.

Furthermore, the potential sensor is apt to become dirty with toner or the like during its use and this gradually deteriorates the sensitivity of the potential sensor. Therefore, a correction is also required in the output from the potential sensor in the above case and reproductions of a good quality will not be obtained unless a correction is made.

Not only copiers but also image forming apparatus of all types including laser printers and electrophotographic facsimiles and the like have the same problem as the above-mentioned.

The object of the present invention is to provide an image forming apparatus in which the output from the potential sensor can be automatically corrected during the use of a copier.

SUMMARY OF THE INVENTION

The image forming apparatus according to the present invention is provided with a potential sensor for measuring the potential at the surface of the photoreceptor drum; a high-voltage generation circuit for generating a predetermined high voltage; switching means by which the photoreceptor drum is connected to the high-voltage generation circuit or earthed; memory means for storing the measured value of the potential at the surface of the photoreceptor drum obtained by the potential sensor, when a high voltage is applied to the photoreceptor drum by switching the switch means; and charger-output control means for controlling the output from the charger based on the measured value stored in the memory means when a voltage is applied to the photoreceptor surface by the charger prior to the image forming operation.

At a predetermined timing, the switch means is switched thereby directly applying a high voltage from the high-voltage generation circuit to the photoreceptor and at that time, the surface potential of the photoreceptor is measured by the potential sensor. In the next series of image forming operations, when the surface of the photoreceptor is charged by the charger the output of the charger is adjusted to be equal to the measured value that has been read out by the potential sensor. Accordingly, the photoreceptor is kept to be charged at a desired potential.

An image forming apparatus is generally provided with a high-voltage generatiOn circuit for biasing a developing device and/or a high-voltage generation circuit for applying a voltage to a charger. In the case the photoreceptor is directly biased by a high voltage, it is preferable to employ the above high-voltage generation circuit since the number of parts in the image forming apparatus can be decreased.

Now the present invention will be clarified in detail by the description of embodiments thereof to be taken in conjunction with the accompanying drawings.

DESCRIPTION OF THE PREFERRED EMBODIMENTS

(I) Outline of the Operation of a Copier

Figure 2:
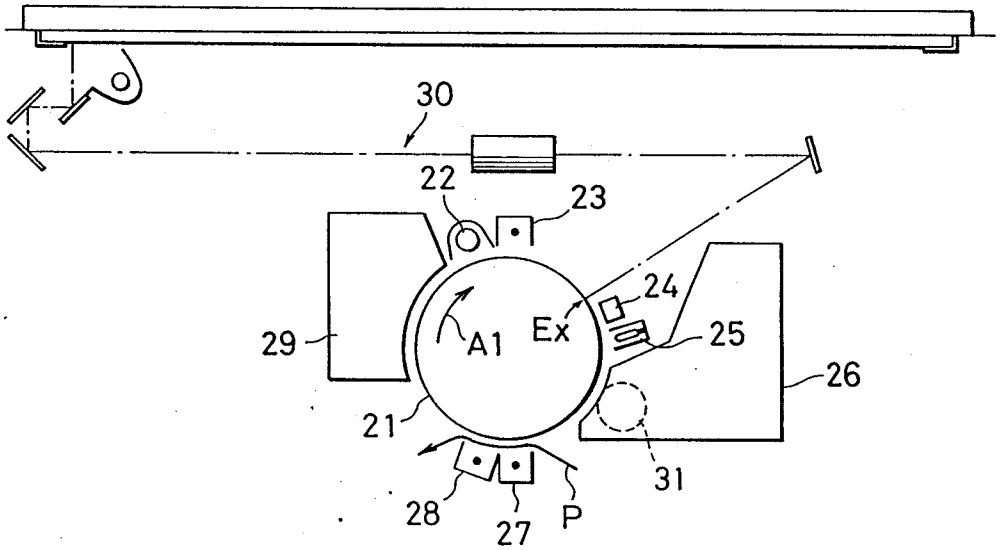
FIG. 2 is a schematic view showing the mechanical structure of an image forming system and peripheral devices in an electrophotographic copier according to the embodiment of the present invention.

FIG. 2 is a schematic view showing the mechanical structure of an image forming system and peripheral devices in a copier according to an embodiment of the present invention. The copier is provided with a photoreceptor drum 21 in a cylindrical shape, and in the periphery thereof, charge eliminating lamps 22, a main corona discharger 23, a potential sensor 24, blank lamps 25, a developing device 26, a transferring corona discharger 27, a separating corona discharger 28 and a cleaner 29 are arranged in this order along the rotating direction A1 of the photoreceptor 21.

In the photoreceptor drum 21, an exposure position Ex is set between the main corona discharger 23 and potential sensor 24 and the light from an optical system 30 is irradiated thereto.

The operation of a copier will be briefly described below.

During copying operation, the photoreceptor drum 21 is rotated in the direction of an arrow A1 at a fixed speed, and after the residual charge at the surface of the drum is eliminated by the charge eliminating lamps 22, the surface of the drum is charged at a fixed potential by the main corona discharger 23. Then, the reflected light from an original is irradiated to the exposure position Ex via the optical system 30. The above exposure allows the electric charge to be eliminated in the area which has been exposed to light thereby forming an electrostatic latent image at the surface of the photoreceptor drum 21. Unnecessary electric charge in the area that has been unexposed being shaded by the leading edge portion or the side edge portion of an original for instance, is eliminated by the blank lamps 25.

Toner is then fed and sticked to the surface of the photoreceptor drum 21 by the developing device 26 and an electrostatic latent image is developed into a toner image by toner. Toner is fed to the surface of the photoreceptor drum 21 by a developing roller 31 disposed in the developing device 26. At that time, a developing bias voltage having the same potential as at the surface of the photoreceptor drum 21 is applied to the developing roller 31 in order to prevent the photoreceptor drum 21 from being provided with an excessive amount of toner at the surface thereof.

In association with the above-described operation, a copy sheet P is fed by a paper feeding unit (not shown in the drawings) and a toner image formed on the surface of the photoreceptor drum 21 is transferred onto the copy sheet P by means of the transferring corona discharger 27. Then, the copy sheet P having a toner image transferred thereon is separated from the surface of the drum by the separating corona discharger 28 and then guided to a fixing unit (not shown in the drawings).

Thereafter, the residual toner at the surface of the photoreceptor drum 21 is removed by the cleaner 29 and the residual charge is eliminated by the charge eliminating lamps 22.

In the series of operations above mentioned, when the surface of the photoreceptor drum 21 is charged at a potential by the main corona discharger 23, if the surface of the photoreceptor drum 21 fails to be charged at a desired fixed potential, this will exert a great influence upon the exposure and development that will be successively carried out and as a result, an image to be transferred onto the copy sheet P will be unclear.

From the above reason, it is required to control the output from the main corona discharger 23 so that the charged surface of the photoreceptor drum 21 is maintained at a fixed potential.

(II) The First Embodiment

This embodiment is provided with the control circuit as described above.

Figure 1:
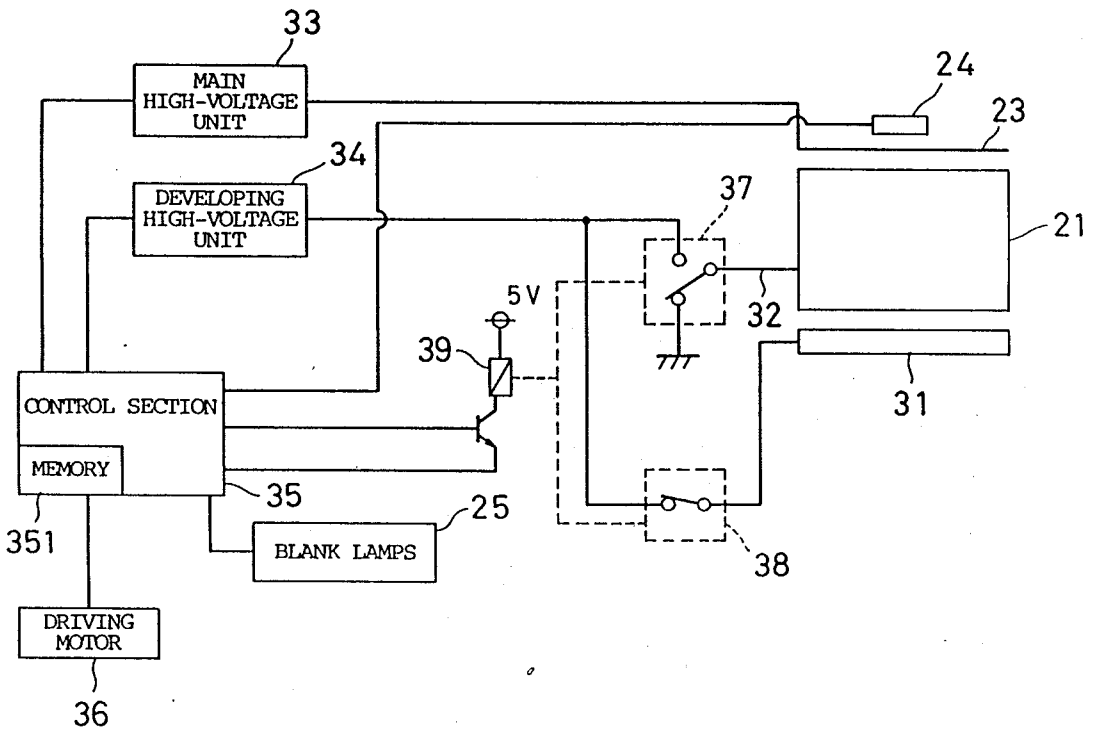
FIG. 1 is a structural block diagram showing a control circuit according to an embodiment of the present invention.

FIG. 1 is a block diagram showing the electrical construction of the control circuit in the above embodiment.

Referring now to FIG. 1, the photoreceptor drum 21 is normally earthed via an earthing route 32. In order to eliminate electric charge at the surface of the photoreceptor drum 21 by exposure as described above, the photoreceptor drum 21 is required to be earthed all the time thereby assuring an outlet for the above electric charge.

A high voltage is applied to the main corona discharger 23 by a main high-voltage unit 33 which is under the control of the control section 35. A developing high-voltage unit 34 for applying a fixed developing bias voltage is connected to the developing roller 31. The developing high-voltage unit 34 is also under the control of the control section 35. The potential sensor 24 is connected to the control section 35 and a measured value obtained by the potential sensor 24 is sent to the control section 35 and then stored in a memory 351. A driving motor 36 for driving the photoreceptor drum 21 and other mechanisms in the copier, and the blank lamps 25 are further connected to the control section 35.

One of the characteristics of this embodiment is that a first change-over switch 37 is inserted in the earthing route 32 in the photoreceptor drum 21, by means of which it is possible to selectively switch a condition so that the photoreceptor drum 21 is earthed or connected to the developing high-voltage unit 34. A second change-over switch 38 is provided for disconnecting the developing roller 31 from the developing high-voltage unit 34 when the photoreceptor drum 21 is connected to the developing high-voltage unit 34 by the first change-over switch 37. The operation of the first change-over switch 37 is interlocked with that of the second change-over switch 38 by means of a relay 39 that is controlled by the control section 35.

Figure 3:
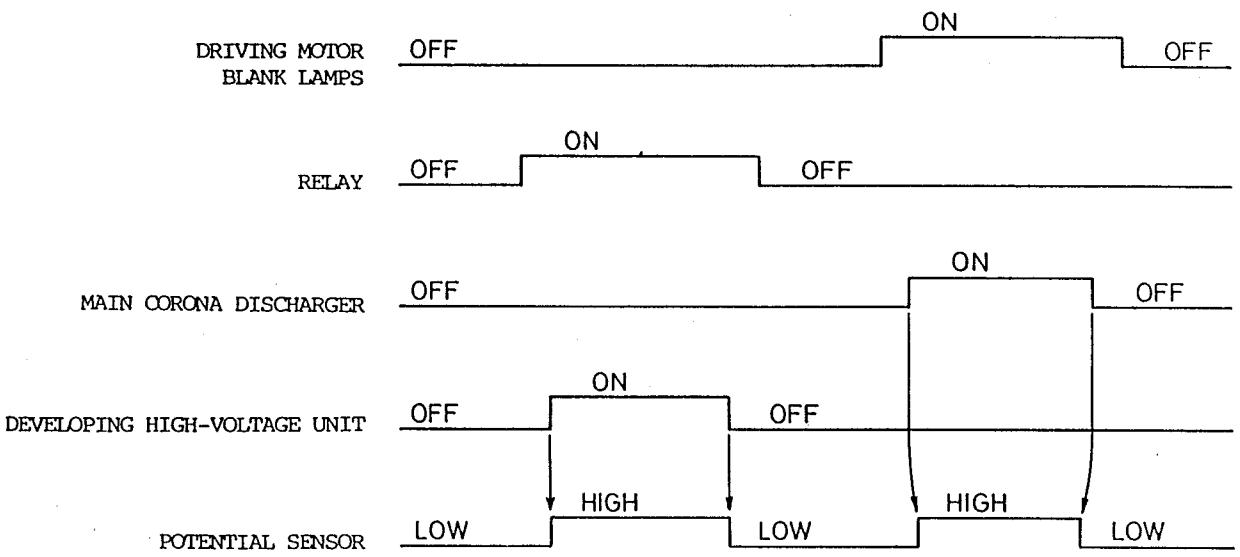
FIG. 3 is a timing chart showing the timing operations at the control circuit shown in FIG. 1.
Figure 4:
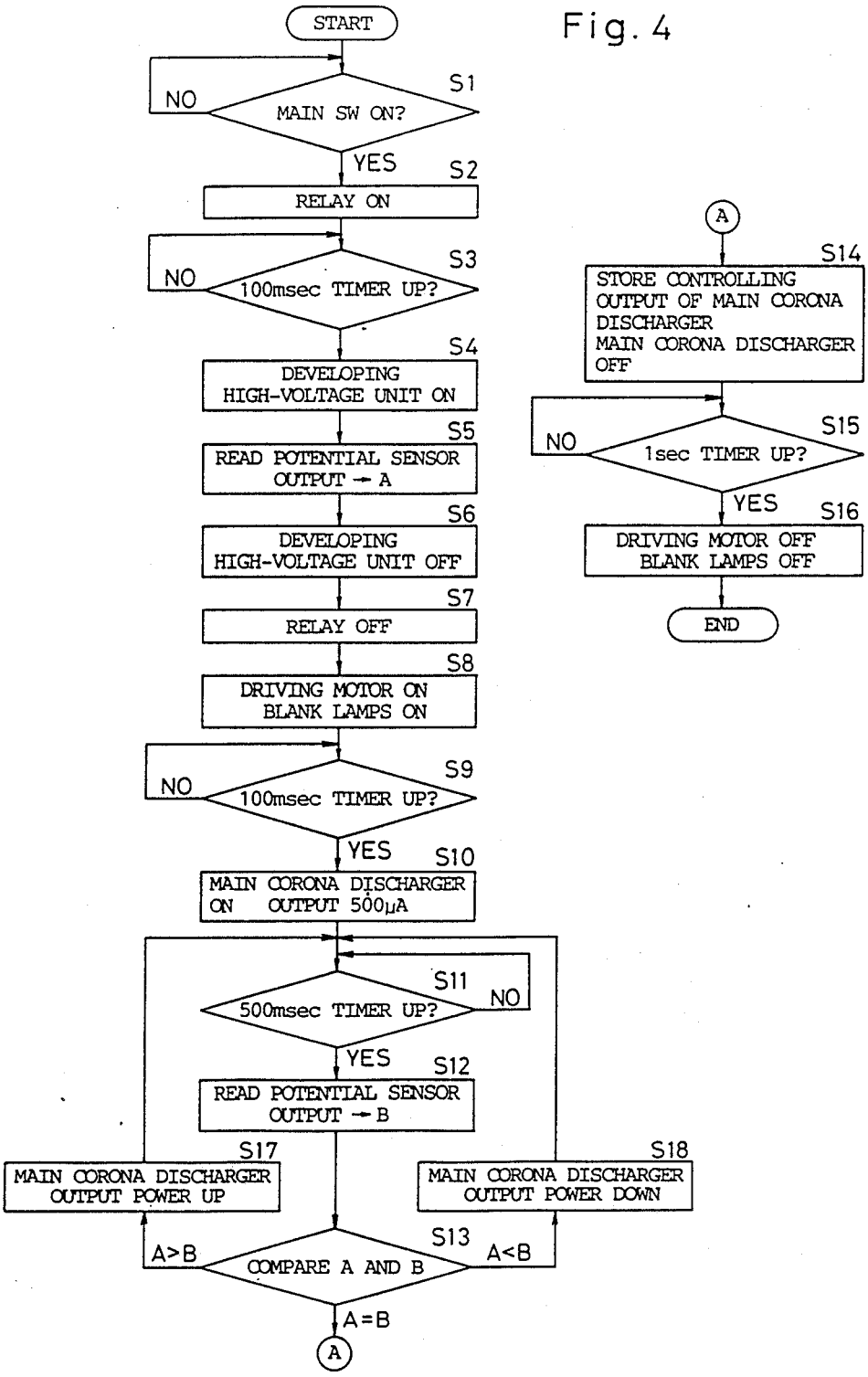
FIG. 4 is a flow chart describing the operation of the control section 35 in the control circuit shown in FIG. 1.

FIG. 3 is a timing chart showing the timing operations of the driving motor 36 and blank lamps 25, relay 39, main corona discharger 23 (i.e., main high-voltage unit 33), developing high-voltage unit 34 and potential sensor 24. FIG. 4 is a flow chart showing the control operation of the control section 35 shown in the block diagram of FIG. 1.

The operation of the control circuit shown in FIG. 1 will now be explained in accordance with FIG. 3 and FIG. 4, particularly following the flow of FIG. 4.

When it is determined that a main switch of the copier is turned on (step S1), the control section 35 turns on the relay 39 (step S2) whereby the first change-over switch 37 and the second change-over switch 38 are operated so that both switches are in the opposite state to that shown in FIG. 1. That is, the photoreceptor drum 21 is connected to the developing high-voltage unit 34 and the developing roller 31 is disconnected from the developing high-voltage unit 34.

After waiting for a while (e.g. 100 msec. later) (step S3), the control section 35 turns on the developing high-voltage unit 34 (step S4), and a fixed high voltage is directly applied to the photoreceptor drum 21 by the developing high-voltage unit 34.

The above fixed high voltage has to be determined based on the voltage in a position at the surface of the photoreceptor drum 21 which is rotating during the image forming operation, the position being opposite to the developing roller 31 (For example, this high voltage is set to 700 volts). Since the surface of the photoreceptor drum 21 is losing electric charge for some reasons as it rotates, a certain potential difference (e.g. 100 volts) will be caused between the face opposite to the potential sensor 24 and the face opposite to the developing roller 31, these faces being opposite to each other. Accordingly, the voltage to be applied when a high voltage is directly applied to the photoreceptor drum 21 may be obtained by adding the voltage in the position opposite to the developing roller 31 to the potential difference (Total voltage is 800 volts).

The reason why the control section 35 waits for 100 msec. after turning on the relay 39 until turing on the developing high-voltage 34 is that the switching of the first change-over switch 37 and the second change-over switch 38 is securely executed by the relay 39 within this time.

In the next step (step S5), the output from the potential sensor 24 at the time when a high voltage, i.e. 800 volts is directly applied to the photoreceptor drum 21 is read out, and then the value thus obtained (e.g. 3 volts) is stored in an area A in the memory 351.

Thereafter, the control section 35 turns off the developing high-voltage unit 34 (step S6) and the relay 39 (step S7), whereby the first change-over switch 37 and second change-over switch 38 are switched so as to be in the state shown in FIG. 1, the photoreceptor drum 21 is earthed, and the developing roller 31 is connected to the developing high-voltage unit 34.

The control section 35 turns on the driving motor 36 and all the blank lamps 25 (step S8), and then waits for 100 msec. until the rotation of the driving motor 36 (step S9) is stabilized. The main high-voltage unit 33 is actuated thereby turning on the main corona discharger 23 so that the output therefrom becomes 500 microamperes (step S10). The purpose of turning on all the blank lamps 25 in step S8 is to prevent the electric charge from being developed by the developing device in the later process.

After 500 msec. has elapsed (step S11), the output from the potential sensor 24 is read out and the value thereof is then stored in an area B in the memory 351 (step S12). The control section 35 waits for 500 msec. in step S11 for the purpose of waiting for the area charged by the main corona discharger 23 at the surface of the photoreceptor drum 21 to rotate and come in a position opposite to the potential sensor 24.

In the next step (step S13), the control section 35 compares the stored values in the area A and the area B in the memory 351, and if the value in the area A is greater than the value in the area B, the main high-voltage unit 33 is controlled to increase the output from the main corona discharger 23 by a certain amount (step S17). Conversely, if the value in the area A is smaller than that in the area B, the high-voltage unit 33 is controlled to decrease the output from the main corona discharger 23 by a certain amount (step S18). After the output from the main corona discharger 23 is increased or decreased by a certain amount by means of the main high-voltage unit 33, the processes of steps S11, S12 and S13 are repeated again.

If it is determined in step S13 that the stored value in the area A is coincident with that in the area B in the memory 351, or the difference therebetween is within a predetermined allowable range, the control section 35 stores the output from the main high-voltage unit 33 when it controls the main corona discharger 23, and then turns off the main corona discharger 23 (step S14).

After waiting for 1 sec. (step S15), the control section 35 turns off the driving motor 35 and blank lamps 25 (step S16), and completes the operation. The control section 35 waits for 1 sec. in step S15 for the purpose of waiting for the area charged by the main corona discharger 23 at the surface of the photoreceptor drum 21 to rotate and come in a position opposite to the blank lamps 25.

The photoreceptor drum 21 may be charged at a fixed potential in accordance with the stored value of the output from the main corona discharger 23, in the copying processes onward. Accordingly, the electric potential of the photoreceptor is maintained at a desired value and this makes it possible to form a clear image of good quality.

(III) The Second Embodiment

In the first embodiment described above, 800 volts is directly applied to the photoreceptor drum 21 by the developing high-voltage unit 34 in step S4 and the output from the potential sensor 24 at that time is read out in step S5. However, in case it is structurally difficult to directly apply 800 volts from the developing high-voltage unit 34 to the photoreceptor drum 21, or some problems arise in the wiring, the second embodiment described below may be adopted. The subject in the second embodiment corresponds to claims 1 to 5 in this invention.

Figure 5:
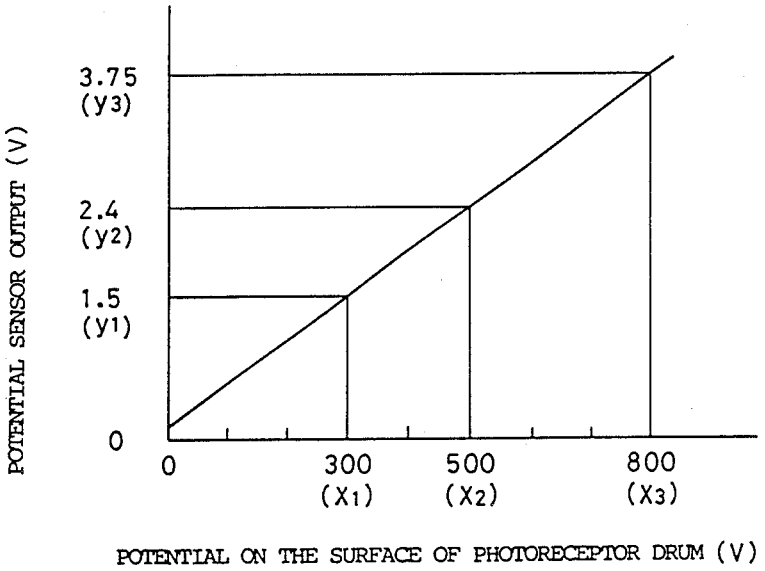
FIG. 5 is a graph showing the relationship between the voltage applied to a photoreceptor drum 21 and the output from a potential sensor 24 according to another embodiment of the present invention.

Referring to FIG. 5, x1 volt (e.g. 300 volts) is applied to the photoreceptor drum 21 by the developing high-voltage unit 34 and the output y1 (e.g. 1.5 volt) from the potential sensor 24 at that time is read out Thereafter, x2 volt (e.g. 500 volts) is applied to the photoreceptor drum 21 by the developing high-voltage unit 34 and the output y2 (e.g. 2.4 volts) from the potential sensor 24 at that time is read out. By using the values x1, y1, x2 and y2, the output y3 from the potential sensor 24 in the case the value x3 (e.g. 800 volts) would be applied to the photoreceptor drum 21 is estimated by the following equation (1).

$$y3 = y1 + \frac{y2 - y1}{x2 - x1} \times (x3 - x1) \quad (1)$$

In the above method, there is no need to directly apply a high voltage such as 800 volts to the photoreceptor drum 21 and a voltage lower than that is sufficient to be applied.

Figure 6A:
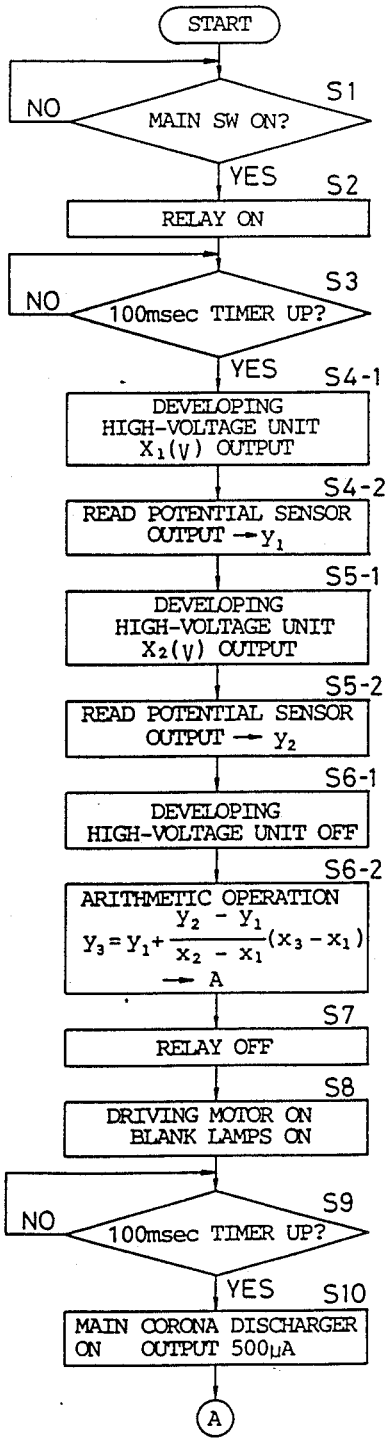
FIGS. 6A and 6B is a flow chart describing the operation of the control section 35 according to the second embodiment of the present invention.
Figure 6:
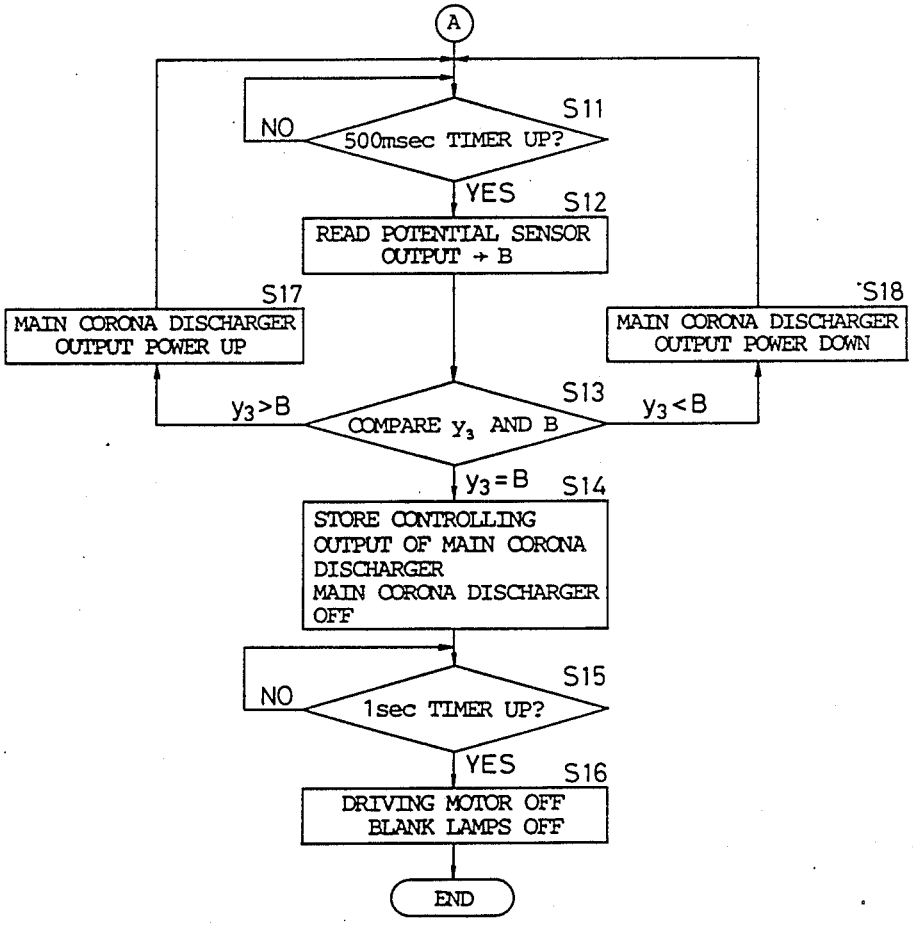

FIG. 6 is a flow chart explaining the control operation of the control section 35 in accordance with the second embodiment. In this embodiment, step S4 in FIG. 4 is replaced with steps S4-1 and S4-2; step S5 in FIG. 4 is replaced with steps 5-I and S5-2; and step S6 is replaced with steps S6-1 and S6-2. In step S4-1, x1 volt is applied and in step S4-2, the output y1 from the potential sensor 24 at that time is read out. In the next step S5-1, x2 volt is applied to the photoreceptor drum 21 and in step S5-2, the output y2 from the potential sensor 24 at that time is read out. Thereafter, the developing high-voltage unit 34 is turned off in step S6-1, and in step S6-2 the output y3 in the case the value x3 is applied to the photoreceptor drum 21 is calculated using the above equation (1).

As described above, in the second embodiment, even if the developing high-voltage unit 34 has the capacity of 500-volt output only, the output y3 from the potential sensor 24 when 800 volts would be applied to the photoreceptor drum 21 can be estimated, and therefore there is no need to exchange the above developing high-voltage unit 34 with a developing high-voltage unit having the capacity of 800-volt output. The second embodiment is also advantaged in that the existing devices and wiring can be utilized without increasing the allowable capacity of the voltage carried in the wiring from the developing high-voltage unit 34 to the photoreceptor drum 21.

(IV) The Third Embodiment

Figure 7:
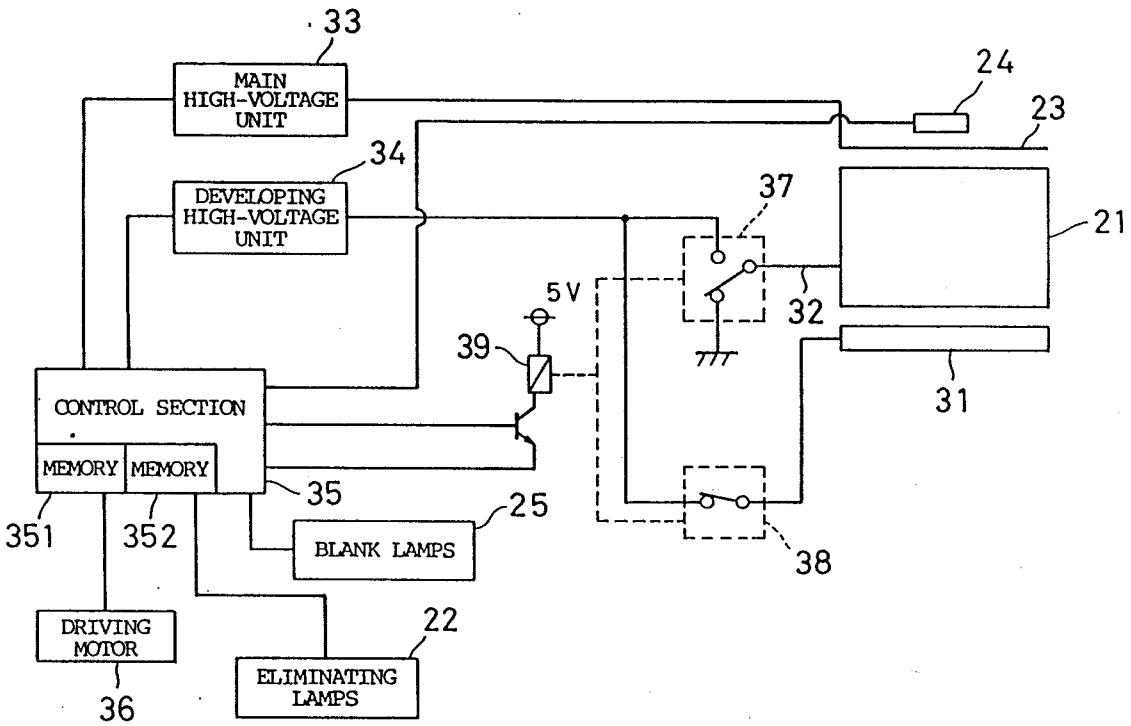
FIG. 7 is a structural block diagram showing a control circuit according to a further embodiment of the present invention.
Figure 8:
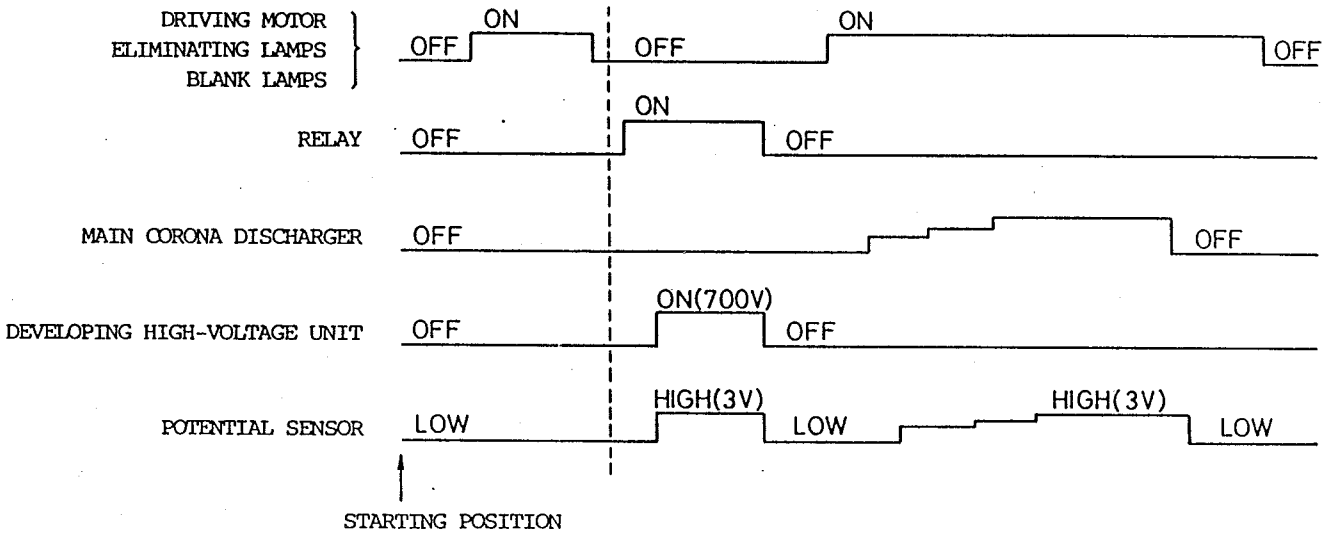
FIG. 8 is a timing chart showing the timing operations at the control circuit shown in FIG. 7.
Figure 9:
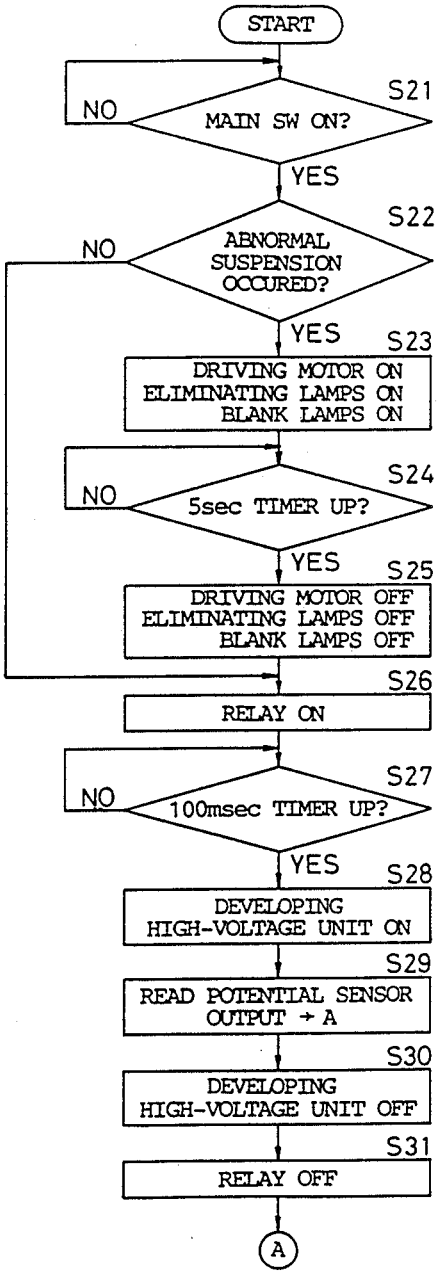
FIGS. 9A and 9B is a flow chart describing the operation of the control section 35 in the control circuit shown in FIG. 7.
Figure 9:
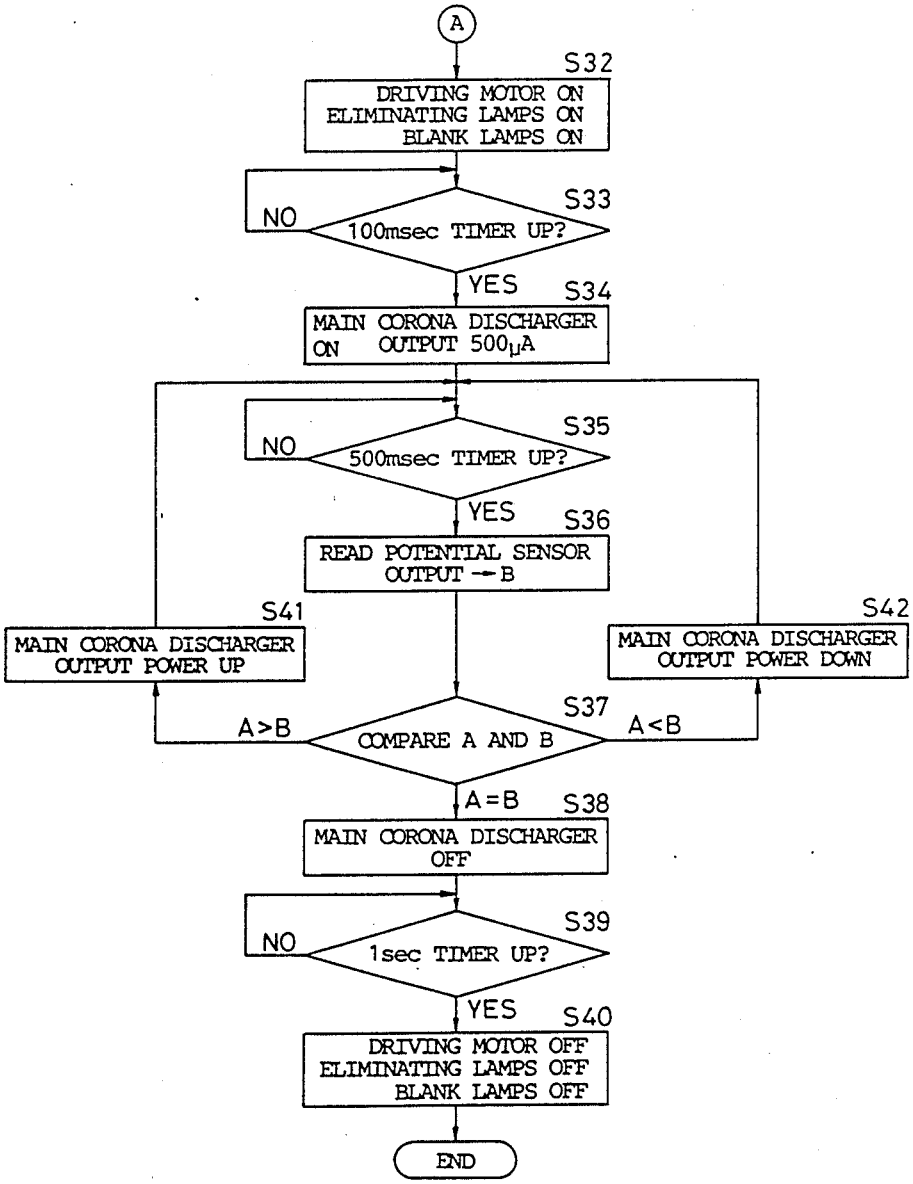

FIGS. 7 to 9 show a still further embodiment. The subject of the third embodiment corresponds to claims 6 to 10. This embodiment is arranged such that when it is judged that electric charge remains at the surface of the photoreceptor before the switching means is switched by the switching signal generating means, electric charge is eliminated and thereafter the switching means is switched. Electric charge usually remains at the surface of a photoreceptor when the operation of the apparatus is suspended due to troubles or the like occured therein.

FIG. 7 is a schematic structural view showing an electrical structure of the image forming system and peripheral devices in a copier. This FIG. differs from FIG. 1 in that the control section 35 in FIG. 1 includes a memory 352 disposed in the outside of the memory 351. The memory 352 consists of flags having one bit or several bits and these flags are arranged to be set in case the operation of the copier is suspended due to troubles.

FIG. 8 is a timing chart showing the timing operations at the members and FIG. 9 is a flow chart showing the operation of the control circuit shown in FIG. 7.

FIG. 9 differs from FIG. 4 in that steps S22 to S25 are added in FIG. 9. Step S21 corresponds to step S1, and steps S26 to S42 correspond to steps S2 to S18.

In FIG. 9, after judging that the main switch of the copier is turned on (step S21), the control section 35 determines based on the internal storage in the memory 352 whether or not the operation of the copier is suspended due to troubles before the main switch is turned on (step S22). The above mentioned suspension occurs when a paper jam occurs in the course of copying operation for example. In case such a suspension occurs, the flags in the memory 352 are set as mentioned above.

When the operation of the copier is suspended due to troubles, the control section 35 turns on the driving motor 36, charge eliminating lamps 22 and blank lamps 25 for a while (e.g. 5 sec.)(step S23, S24 and S25). The operations of the above members when they are in their on-positions are shown in the left hand with respect to the dotted line D in the timing chart FIG. 8.

Accordingly, even if a suspension due to troubles occurs in the copier and this causes residual electric charge at the surface of the photoreceptor drum 21, the electric charge will be all eliminated. Such elimination of electric charge may be carried out by turning either of the charge eliminating lamps 22 or the blank lamps 25.

In the third embodiment, the residual electric charge is eliminated for fear that electric load will be overlappingly excessively charged if a high voltage is applied by the developing high-voltage unit 34 to the surface of the photoreceptor drum 21 where residual electric charge exists.

When the operation of the copier is normally terminated, there is no residual electric charge at the surface of the photoreceptor drum 21, and therefore such charge eliminating operation may be omitted.

Afterwards, the control section 35 performs the control operation in the same procedure as in step S2 onward in FIG. 4, and the explanation thereof is therefore omitted.

(v) The Fourth Embodiment

Figure 10A:
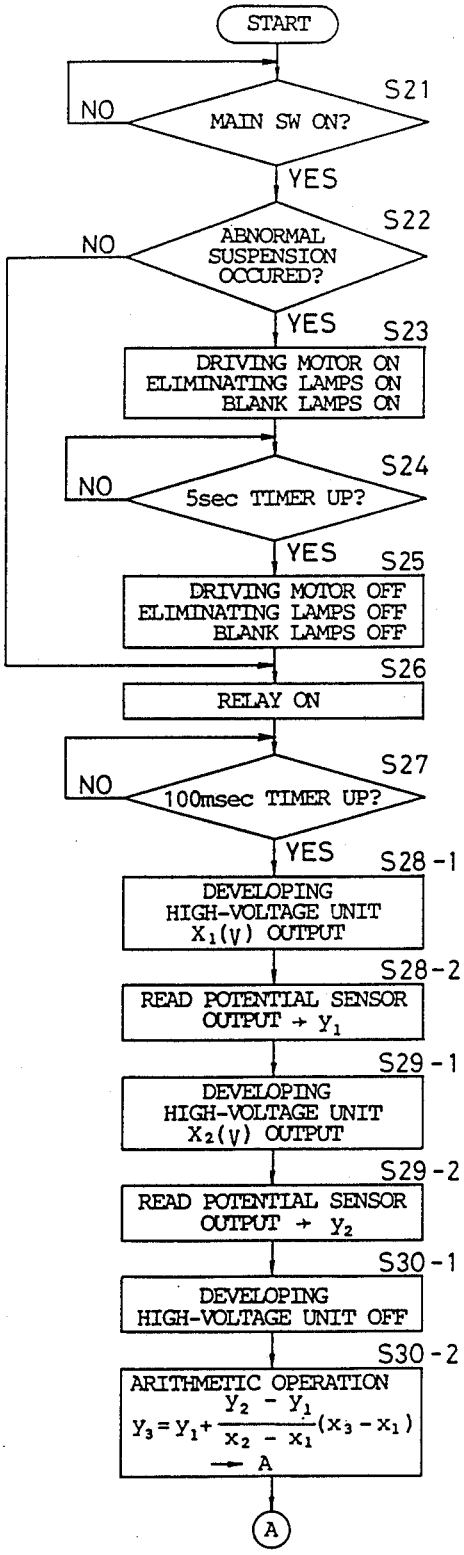
FIGS. 10A and 10B is a flow chart describing the operation of the control section 35 according to a still further embodiment of the present invention.
Figure 10:
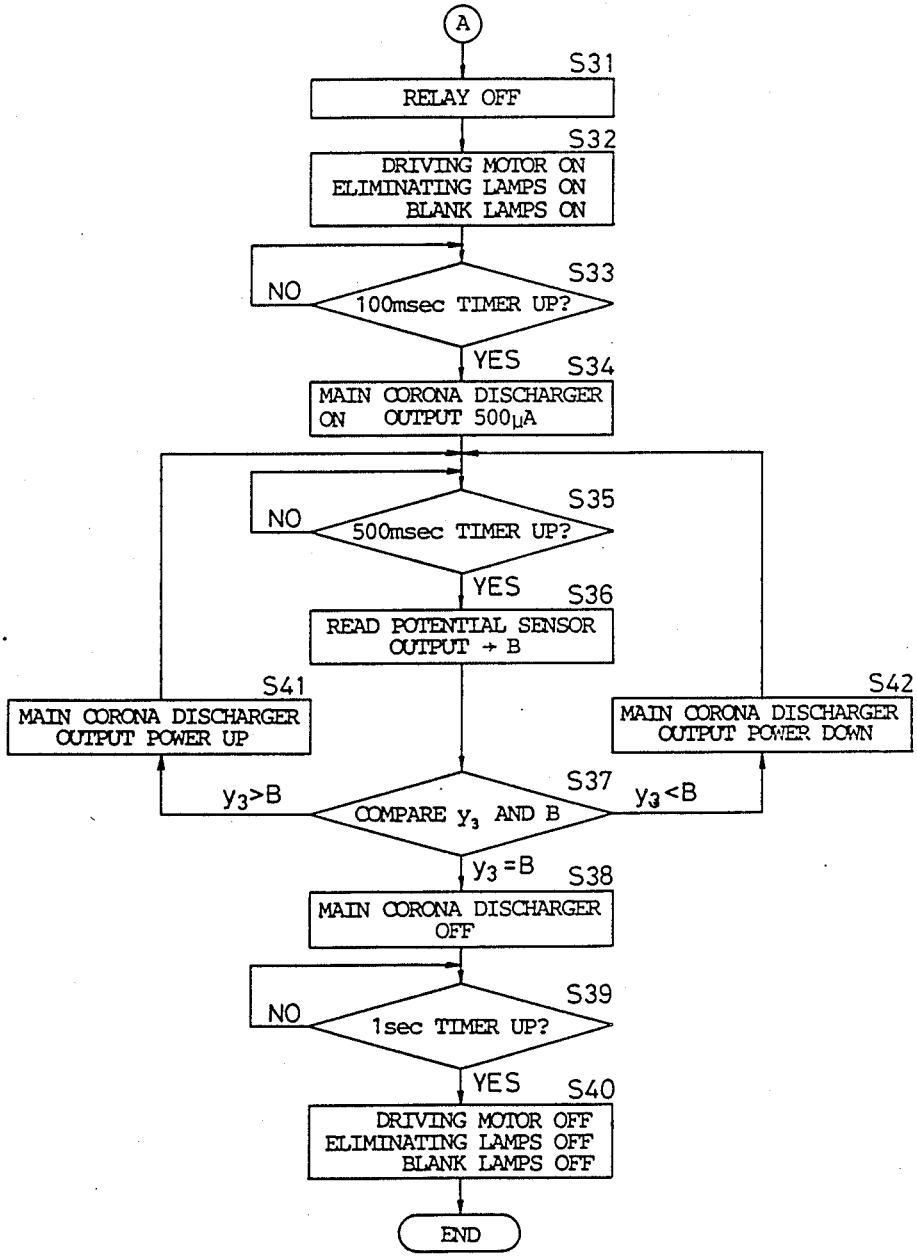
Figure 11:
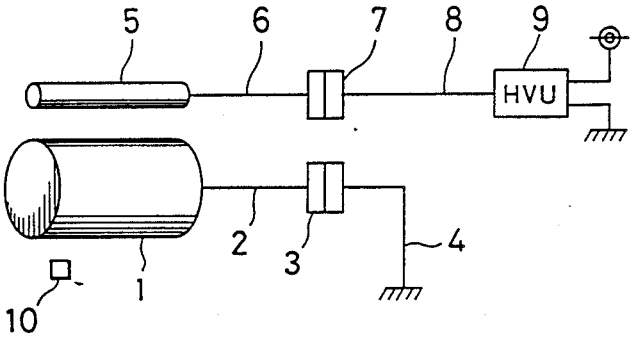
FIG. 11 is an illustration showing the relationship among a photoreceptor drum, developing roller and potential sensor in a conventional copier.

FIG. 10 shows the fourth embodiment of the present invention. The fourth embodiment is a combination of the second embodiment and the third embodiment, and corresponds to claim 11.

FIG. 10 is a flow chart showing the control operation of the control section 35 according to the fourth embodiment. Steps S28, S29, and S30 in FIG. 9 are respectively replaced with FIGS. 28-1 and 28-2; FIGS. 29-1 and 29-2; and FIGS. 30-1 and 30-2 in this embodiment.

The explanations of the respective steps S281, S28-2, S29-1, S29-2, S30-1 and S30-2 are the same as those made to FIG. 6.

While the invention has been described with respect to preferred embodiments thereof, it is to be understood that the present invention is not limited thereto, but various modifications may be applied. In the foregoing embodiments, such an arrangement is made that each time the main switch of the copier is turned on, the output from the potential sensor 24 is corrected (see step S1 in FIG. 4 as an example), and the output from the main corona discharger 23 is controlled based on the output from the potential sensor 24 thus corrected. However, the output from the potential sensor 24 may be corrected each time a certain number of copying operations are performed (e.g. 10,000 times of copying operations), and on the basis of the corrected output, the output from the main corona discharger 23 may be controlled.

When a high voltage is applied to the photoreceptor drum 21 for the correction of the output from the potential sensor 24, a high voltage may be applied by the main high-voltage unit 33 instead of the developing high-voltage unit 34.

The present invention also may be applied to not only copiers but also other image forming apparatus such as laser printers, electrophotographic facsimiles and the like.

What we claim is:

1. An image forming apparatus comprising a photoreceptor;

a charger disposed in an opposite position to the surface of the photoreceptor, for charging the surface of the photoreceptor opposite thereto at a fixed potential by corona discharge;

exposure means for exposing an original image so as to form an electrostatic latent image on the surface of the photoreceptor which has been charged by the charger at a fixed potential;

a developing device for developing the electrostatic latent image which has been formed by exposure, into a toner image;

transferring means for transferring the toner image thus developed onto a copy sheet;

a voltage generation circuit for generating a voltage lower than a voltage to be actually induced at the surface of the photoreceptor in the course of image formation;

switching means for switching a state so that said photoreceptor is connected to the voltage generation circuit or earthed;

a potential sensor for measuring an electric potential at the surface of said photoreceptor;

switching signal generating means for outputting a switching signal to the switching means so that a voltage is directly applied to the photoreceptor from the voltage generation circuit at a predetermined timing;

arithmetic operation means for estimating by arithmetic operation a value of a surface potential on the photoreceptor when a high voltage is actually induced on the surface of the photoreceptor during the image formation, said value being estimated on the basis of the value of the surface potential of the photoreceptor which has been measured by the potential sensor at the time when a voltage is applied to the photoreceptor from the voltage generation circuit by operating the switching means:

charger-output control means for controlling an output of the charger based on the estimated value which has been obtained by arithmetic operation by the arithmetic operation means, when applying a voltage to the surface of the photoreceptor by the charger.

2. An image forming apparatus according to claim 1 wherein a high-voltage generating circuit for generating the developing bias is used as said voltage generation circuit.

3. An image forming apparatus according to claim 1 wherein a circuit for applying a voltage to the charger is used as said voltage generation circuit.

4. An image forming apparatus according to claim 1 wherein said switching signal generating means generates a switching signal when a main switch is turned to its on-position.

5. An image forming apparatus according to claim 1 wherein said switching signal generating means generates a switching signal each time a certain number of image formations are completed.

6. An image forming apparatus including a photoreceptor;

a charger disposed in an opposite position to the surface of the photoreceptor, for charging the surface of the photoreceptor opposite thereto at a fixed potential by corona discharge;

a charge eliminating device for eliminating the surface potential of the photoreceptor;

exposure means for exposing an original image to form an electrostatic latent image on the surface of the photoreceptor that has been charged at a fixed potential by the charger;

a developing device for developing the electrostatic latent image that has been formed by exposure, into a toner image;

transferring means for transferring the toner image thus developed onto a copy sheet;

a high-voltage generation circuit for generating a predetermined high voltage;

switching means for switching a state so that the photoreceptor is connected to the high-voltage generation circuit or earthed;

a potential sensor for measuring the electric potential at the surface of the photoreceptor;

judging means for judging whether or not an abnormal suspension has occured in the operation of the image forming apparatus at a predetermined timing;

charge-eliminating-device driving means for driving the charge eliminating device if it is judged that an abnormal suspension occured in the operation of the image forming apparatus;

switching signal generating means for outputting a switching signal to the switching means so that a high voltage is directly applied to the photoreceptor from the high-voltage generation circuit on condition that it is judged that no abnormal suspension occured or on condition that the charge-eliminating-device driving means has been driven;

memory means for storing the measured value of the surface potential of the photoreceptor which is obtained by the potential sensor when a high voltage is applied to the photoreceptor by switching the switching means;

charger-output control means for controlling an output of the charger on the basis of the measured value stored in the memory means, when applying a voltage to the surface of the photoreceptor by the charger.

7. An image forming apparatus according to claim 6 wherein a circuit for generating the developing bias is used as the high-voltage generation circuit.

8. An image forming apparatus according to claim 6 wherein a circuit for applying a voltage to the charger is used as the high-voltage generation circuit.

9. An image forming apparatus according to claim 6 wherein the predetermined timing in the process of the image formation at which the judging means starts its operation is at the time when a main switch is turned on.

10. An image forming apparatus according to claim 6 wherein the predetermined timing in the process of the image formation at which the judging means starts its operation is at the time when a certain number of image formations are completed.

11. An image forming apparatus including a photoreceptor;

a charger disposed in an opposite position to the surface of the photoreceptor, for charging the surface of the photoreceptor opposite thereto at a fixed potential by corona discharge;

a charge eliminating device for eliminating the surface potential of the photoreceptor;

exposure means for exposing an original image so as to form an electrostatic latent image on the surface of the photoreceptor which has been charged at a fixed potential by the charger;

a developing device for developing the electrostatic latent image formed by exposure, into a toner image;

transferring means for transferring the toner image thus developed onto a copy sheet;

a voltage generation circuit for generating a voltage lower than a voltage to be actually induced at the surface of the photoreceptor in the process of image formation;

switching means for switching a state so that the photoreceptor is connected to the voltage generation circuit or earthed;

a potential sensor for measuring an electric potential at the surface of the photoreceptor;

judging means for judging whether or not an abnormal suspension has occured in the operation of the image forming apparatus at a predetermined timing;

charge-eliminating-device driving means for driving the charge eliminating device if it is judged that an abnormal suspension has occured in the process of the image formation;

switching signal generating means for outputting a switching signal to the switching means so that a voltage is directly applied to the photoreceptor from the voltage generation circuit on condition that it is judged that no abnormal suspension has occured or on condition that the charge-eliminating-device driving means has been driven;

arithmetic operation means for estimating by arithmetic operation a value of a surface potential on the photoreceptor when a high voltage is actually induced on the surface of the photoreceptor during the image formation, said value being estimated on the basis of the value of the surface potential of the photoreceptor which has been measured by the potential sensor at the time when a voltage is applied to the photoreceptor from the voltage generation circuit by operating the switching means;

charger-output control means for controlling an output of the charger on the basis of the estimated value obtained by arithmetic operation by the arithmetic operation means when applying a voltage to the surface of the photoreceptor by the charger.

* * * * *